US007841731B2

(12) United States Patent
Marka et al.

(10) Patent No.: US 7,841,731 B2
(45) Date of Patent: Nov. 30, 2010

(54) OPERATING LAMP SYSTEM

(75) Inventors: Rudolf Marka, Ismauing (DE); Dirk Fritze, Emmering (DE)

(73) Assignee: Trumpf Medizin Systeme GmbH + Co. KG, Puchheim (DE)

( * ) Notice: Subject to any disclaimer, the term of this patent is extended or adjusted under 35 U.S.C. 154(b) by 0 days.

(21) Appl. No.: 12/117,063

(22) Filed: May 8, 2008

(65) Prior Publication Data

US 2008/0232086 A1 Sep. 25, 2008

Related U.S. Application Data

(63) Continuation of application No. PCT/EP2006/010914, filed on Nov. 14, 2006.

(30) Foreign Application Priority Data

Nov. 14, 2005 (EP) ..... 05024820

(51) Int. Cl.
*F21V 33/00* (2006.01)

(52) U.S. Cl. ..... 362/85; 362/33; 362/233; 362/269; 362/275; 362/371

(58) Field of Classification Search ..... 362/33, 362/85, 233, 269–270, 275, 287, 371–372, 362/404, 419

See application file for complete search history.

(56) References Cited

U.S. PATENT DOCUMENTS

| | | | | |
|---|---|---|---|---|
| 3,375,362 | A | | 3/1968 | Klippert |
| 4,196,460 | A | | 4/1980 | Schreckendgust |
| 5,383,105 | A | | 1/1995 | Agut |
| 5,497,295 | A | | 3/1996 | Gehly |
| 5,526,245 | A | | 6/1996 | Davis et al. |
| 6,004,005 | A | * | 12/1999 | Demshki, Jr. ..... 362/238 |
| 6,402,351 | B1 | | 6/2002 | Borders et al. |
| 6,488,390 | B1 | | 12/2002 | Lebens et al. |
| 6,513,962 | B1 | | 2/2003 | Mayshack et al. |
| 6,585,395 | B2 | | 7/2003 | Luk |
| 6,603,271 | B2 | | 8/2003 | Noh |
| 6,633,328 | B1 | | 10/2003 | Byrd et al. |
| 6,778,226 | B1 | | 8/2004 | Eshelman et al. |
| 6,863,417 | B2 | | 3/2005 | Hill |
| 6,863,422 | B2 | | 3/2005 | Jesurun et al. |
| 2002/0089857 | A1 | | 7/2002 | Borders et al. |

(Continued)

FOREIGN PATENT DOCUMENTS

| | | |
|---|---|---|
| DE | 9217573 | 8/1993 |

(Continued)

OTHER PUBLICATIONS

International Search Report from corresponding PCT Application No. PCT/EP2006/010914, mailed Jan. 24, 2007, 6 pages.

(Continued)

*Primary Examiner*—Sandra L O Shea
*Assistant Examiner*—Meghan K Dunwiddie
(74) *Attorney, Agent, or Firm*—Fish & Richardson P.C.

(57) ABSTRACT

An operating lamp system is provided that includes several operating lamps, each including a controller. The controllers are interconnected via data lines, wherein data exchange is provided between the controllers. This permits synchronization of the operating lamps.

24 Claims, 1 Drawing Sheet

U.S. PATENT DOCUMENTS

| | | | |
|---|---|---|---|
| 2002/0191389 | A1 | 12/2002 | Hill |
| 2003/0146719 | A1 | 8/2003 | Laerum et al. |
| 2004/0141312 | A1 | 7/2004 | Henning et al. |

FOREIGN PATENT DOCUMENTS

| | | |
|---|---|---|
| DE | 1981984 | 9/1999 |
| DE | 29920746 | 4/2000 |
| EP | 1251722 | 10/2002 |
| EP | 1513376 | 3/2005 |
| JP | 2002015875 | 1/2002 |
| RU | 22847 | 4/2002 |
| RU | 43335 | 1/2005 |
| RU | 2003119444 | 2/2005 |
| SU | 128079 | 12/1959 |
| SU | 1118381 | 10/1984 |
| WO | WO 01/69130 | 9/2001 |
| WO | WO 03/072995 | 9/2003 |
| WO | WO 2003072995 | 9/2003 |

OTHER PUBLICATIONS

Notification of Transmittal of Translation of the International Preliminary Report on Patentability for corresponding PCT Application No. PCT/EP2006/010914, mailed Jun. 19, 2008, 6 pages.

Berchtold Gruppe, "Kamera Vorstellung von neucr OP-Leuchte", Granzbote-Heubergerbote-Trossing Zeitung, Image 1, 2002.

Derungs_DAI Internet Archive, "Way Back Machine" http:dali-ag.org, http://www.archive.org/index.php, 11 pages, 2008.

"Internet chess server-Wikipedia, the free encyclopedia", http://en.wikipedia.org/wiki/Internet_chess_server, pp. 1-3, 2008. Translation.

Dr. Mach, "A Step Into New Dimensions", www.dr-mach.com, pp. 1-3. Translation.

Dr. Mach, "Single Operating Theatre Lamps", www.dr-mach.com, pp. 1-3. Translation.

Schlichter, J. et al., "Computer Supported Cooperative Work (CSCW)", i-com, ISSN 1618-162X, pp. 5-11, 2001. English summary.

* cited by examiner

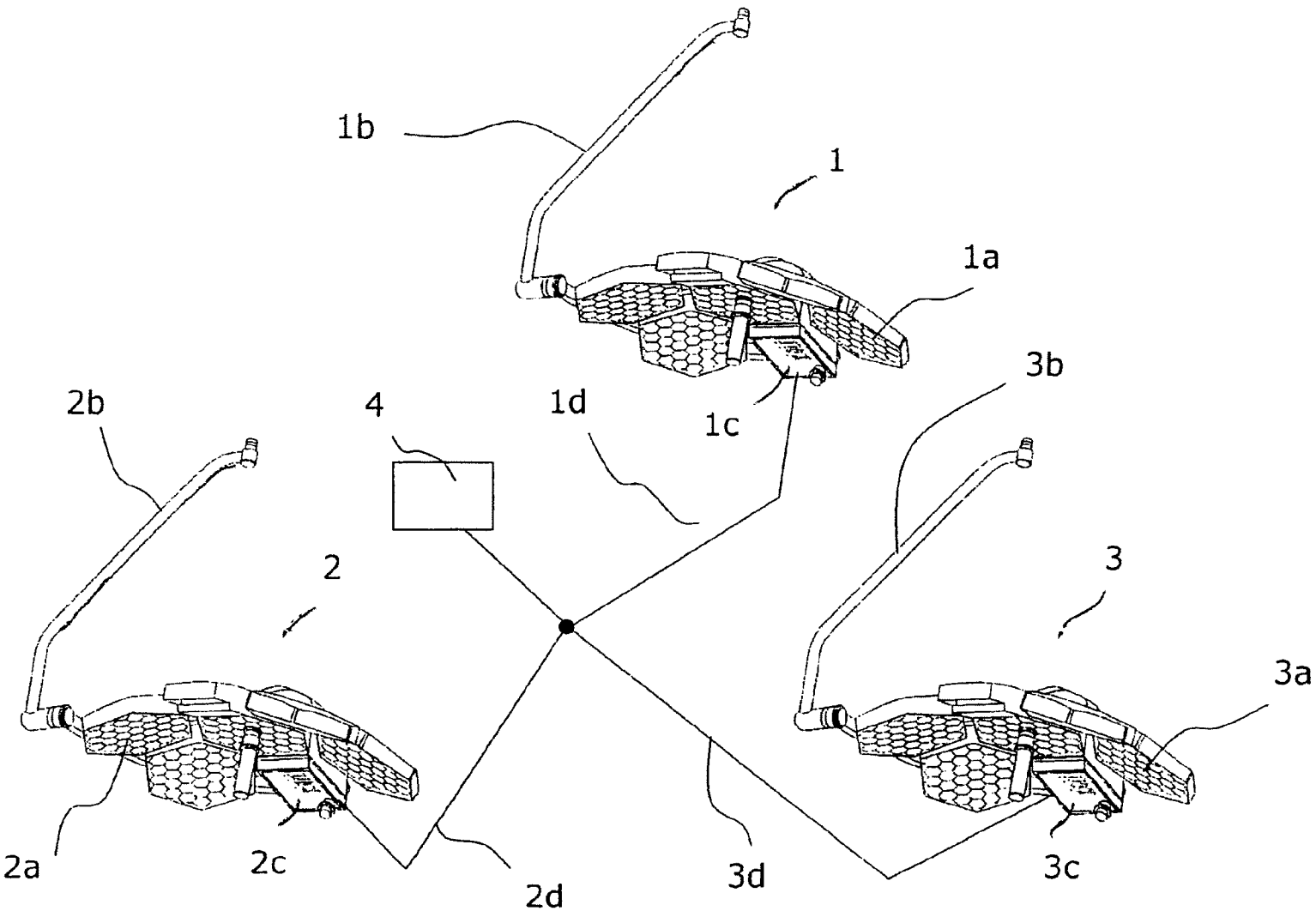
1
1a
1b
1c
1d
2
2a
2b
2c
2d
3
3a
3b
3c
3d
4

OPERATING LAMP SYSTEM

CROSS REFERENCE TO RELATED APPLICATION

This application is a continuation of, and claims priority under 35 U.S.C. §120 to PCT/EP2006/010914, filed on Nov. 14, 2006, and designating the U.S., and claims priority under 35 U.S.C. §119 from European application EP 05024820.2, filed Nov. 14, 2005. These priority applications are hereby incorporated by reference in their entirety.

TECHNICAL FIELD

This invention relates to operating lamp systems and more particularly to operating lamp systems that comprise several operating lamps, each having a controller.

BACKGROUND

Operating lamp systems that comprise several operating lamps, each having a controller, are used in operating rooms and are therefore generally known.

Up to now, it has not been possible to control operating lamps collectively but only separately, see e.g. WO 03/072995 or U.S. Pat. No. 6,402,351.

Operating lamps are often installed as a combination of two or three operating lamps and not as an individual lamp for safety and lighting reasons. The operating parameters of each individual operating lamp are separately adjusted on the housing of each individual lamp.

Modern operating lamps have different operating parameters that can be adjusted. These operating parameters are e.g. the color temperature, the distribution of the emitted light, the brightness and the size of the illumination field or, when an operating lamp with resolved light system or modular construction is used, the overlapping of the individual illumination fields.

SUMMARY

It is an underlying purpose of the invention to further develop a system comprising several operating lamps in such a manner that the operating lamps can be synchronized. This is achieved by a system of the above-mentioned type, wherein data is transferred between the controllers of the individual operating lamps.

In one aspect, the invention features an operating lamp which permits the operating parameters of the other lamps to also be changed by changing the operating parameters of one lamp.

These operating parameters may be separately adjusted for each operating lamp on the operating field of the lamp body, the carrier arms, or the wall operating panel.

In many situations, it may be favorable to simultaneously change the operating parameters of all operating lamps which are in use. When an operating wound is illuminated by two lamp bodies, it may be advantageous that, when the color temperature of one operating lamp changes, the color temperature of the second operating lamp changes synchronously thereto. For this reason, means are provided for synchronizing the operating lamps. This means that the controllers are correspondingly designed to perform automatic communication and mutual matching, if predetermined by the operating surgeon. In a further application, the light intensity may be dimmed. Also in this case, the brightness of two operating lamps which illuminate an operating field can advantageously be synchronously changed. When the illumination is adjusted such that only a very small amount of light is emitted by the operating lamps, which serves as ambient illumination for endoscopic or minimum-invasive operations, the individual lamp bodies are also advantageously commonly switched to this mode, and commonly switched again to an operating mode which permits continuation of the operation with bright light. All lamp bodies can be switched on and off prior to and after operations by means of any operating lamp.

In some cases, it may not be desired to simultaneously change the operating parameters of all installed lamps. When a patient needs to be operated on at different locations, e.g. in bypass operations, where a blood vessel is removed at one location and is inserted at another location, the operating parameters of both lamp bodies must be adjusted independently of each other in order to ensure that the respective operating surgeon has optimum conditions to identify the tissue, i.e. optimum adjustment of the color temperature and illumination of the wound, i.e. brightness and light distribution. In this case, it would not only be disturbing but even dangerous for the patient if the operating lamps were switched off together.

The details of one or more embodiments of the invention are set forth in the accompanying drawings and the description below. Other features and advantages of the invention will be apparent from the description and drawings, and from the claims.

DESCRIPTION OF DRAWINGS

The FIGURE shows in perspective view three interconnected operating lamps.

DETAILED DESCRIPTION

The schematic drawing shows a preferred embodiment of the invention, which is explained with reference to the drawing.

In accordance with the FIGURE, each individual operating lamp 1 through 3 has several light modules 1*a* through 3*a*, a pivot arm 1*b* through 3*b*, and a controller 1*c* through 3*c*. The light modules 1*a* through 3*a* are connected to the pivot arms 1*b* through 3*b* of a support via a carrier, the support being connectable to a ceiling or wall. The light modules 1*a* through 3*a* are each activated by the corresponding controller 1*c* through 3*c*. The controller may alternatively also be installed on the corresponding pivot arm or on a wall of the operating room. Each controller 1*c* through 3*c* has an operating element which permits switching between the individual operating states of the operating lamp 1 through 3 and changing of the parameters also within the operating states:

- on/off (complete switch-off or standby state)
- light intensity (brightness)
- color temperature
- illumination situation (selection of the intensity distribution of the emitted light)
- optional: camera drive (orientation, zoom)

The following parameters are stored in the controller 1*c* through 3*c:*

- Light intensity: e.g. (10%)/50%/60%/70%/80%/90%/100%
- Color temperature: e.g. 3500 K/4000 K/4500 K/5000 K
- Illumination situation: e.g. 1 operating surgeon, 2 operating surgeons;
  - Large-surface wound, deep, narrow wound When the operating lamp 1 is used in a system of several operating lamps, synchronization of the operating parameters may be selected, i.e. when the color temperature of one operating lamp changes, the color temperature of one or more further operating lamps is/are changed to the same value, which is reasonable when an operating field is illuminated by several operating lamps. In an alternative setting, the operating parameters of the individual operating lamps may be separately changed, which may be reasonable when there are several operating fields.

Switching off and on via the sterile operating element activates or deactivates the standby mode. The operating parameters are stored upon switching off and may be further displayed. When the operating lamp 1 through 3 is switched on, it is in the operating state of the stored, last parameters.

Each operating lamp 1 through 3 is associated with its own controller 1*c* through 3*c* which can be driven either via an operating field on the lamp body or on the carrier arms, or via an operating panel on the wall. Each of the controllers 1*c* through 3*c* of all installed operating lamps 1 through 3 has a data interface and communicates with the others via data lines 1*d* through 3*d*. A central controller 4 is optionally also provided. All controllers 1*c* through 3*c* of the operating lamps 1 through 3 are programmed in such a manner that, when a certain operating parameter of any lamp body is changed, the controllers 1*c* through 3*c* of the other operating lamp(s) 1 through 3 recognize the change and synchronously adjust the operating parameters of their respective lamp bodies. One of the operating lamps 1 through 3 can be disconnected from such synchronous operation and be independently adjusted by means of a switch on the lamp body, without changing the operating parameters of the other operating lamp(s). When this operating lamp is readjusted to synchronous operation, it adopts the parameter values of the operating lamps which remained in synchronous operation.

A further function which may be applied for all operating lamps 1 through 3 that are synchronously operated, is resetting of all operating parameters to the switch-on state, i.e., even individual operating lamps 1 through 3 may be reset after disconnecting them from synchronous operation.

A number of embodiments of the invention have been described. Nevertheless, it will be understood that various modifications may be made without departing from the spirit and scope of the invention. Accordingly, other embodiments are within the scope of the following claims.

What is claimed is:

1. An operating lamp system comprising:

a plurality of operating lamps, each operating lamp comprising a controller configured to control one or more operating parameters of the operating lamp, and data lines interconnecting the controllers, the data lines being configured to provide operating parameter data exchange between the controllers.

2. An operating lamp system according to claim 1, further comprising a central controller configured to control the controllers of the operating lamps.

3. An operating lamp system according to claim 1, characterized in that the controllers of each operating lamp are configured so that each controller controls each operating lamp.

4. An operating lamp system according to claim 1, further comprising an operating device for each controller, the operating device being provided on a lamp body, on a carrier arm, or on a wall of an operating room.

5. An operating lamp system according to claim 3, further comprising a device configured to synchronize operation of the individual operating lamps.

6. An operating lamp system according to claim 5, wherein the device is configured to synchronize the adjustment of the color temperature of the individual operating lamps.

7. An operating lamp system according to claim 5, wherein the device is configured to synchronize the adjustment of the light intensity of the individual operating lamps.

8. An operating lamp system according to claim 5, wherein the device is configured so that synchronization of operation of the individual operating lamps can be switched off.

9. A method of adjusting an operating lamp system, the method comprising:

providing a plurality of operating lamps, each operating lamp comprising a controller, and causing operating parameter data to be exchanged between the controllers via data lines interconnecting the controllers to control one or more operating parameters of the operating lamps.

10. A method according to claim 9, further comprising controlling the controllers of the operating lamps using a central controller.

11. A method according to claim 9, further comprising synchronizing operation of the individual operating lamps.

12. A method according to claim 11, wherein synchronizing operation comprises synchronizing the adjustment of the color temperature of the individual operating lamps.

13. A method according to claim 11, wherein synchronizing operation comprises synchronizing the adjustment of the light intensity of the individual operating lamps.

14. A method according to claim 11, further comprising switching off the synchronization of operation of one or more of the operating lamps.

15. The operating lamp system according to claim 1, wherein the one or more operating parameters comprises light intensity and color temperature.

16. The method according to claim 9, wherein the one or more operating parameters comprises light intensity and color temperature.

17. An operating lamp system comprising:

a first operating lamp comprising a first controller configured to control one or more operating parameters of the first operating lamp;

a second operating lamp comprising a second controller configured to control one or more operating parameters of the second operating lamp; and one or more data lines interconnecting the first and second controllers, the one or more data lines being configured to provide operating parameter data exchange between the first and second controllers, wherein the first controller is configured to control the one or more operating parameters of the first operating lamp based on operating parameter data received from the second controller, and the second controller is configured to control the one or more operating parameters of the second operating lamp based on operating parameter data received from the first controller.

18. The operating lamp system according to claim 17, wherein the one or more operating parameters of the first and second operating lamps comprise a light intensity and color temperature.

19. The operating lamp system according to claim 17, wherein the first and second controllers are configured to synchronize the operating parameters of the first and second operating lamps.

20. The operating lamp system according to claim 17, further comprising a third operating lamp comprising a third controller configured to control one or more operating parameters of the third operating lamp, and data lines connecting the third controller to the first and second controllers, wherein the third controller is configured to control the one or more operating parameters of the third operating lamp based on operating parameter data received from the first and second controllers.

21. The operating lamp system according to claim 1, wherein the controller of each operating lamp is configured to recognize a change in an operating parameter of one of the other operating lamps and to synchronously adjust the corresponding operating parameter of its associated operating lamp.

22. The operating lamp system according to claim 21, wherein each operating lamp further comprises an operating device configured to change an operating parameter of its associated operating lamp.

23. A method according to claim 9, wherein the operating parameter data exchanged between the controllers is indicative of an operating parameter change to one of the operating lamps, and, in response to the operating parameter data, the corresponding operating parameter of each of the other operating lamps is synchronously adjusted.

24. A method according to claim 23, further comprising changing the operating parameter of the one of the operating lamps using an operating device of the one of the operating lamps.

* * * * *

UNITED STATES PATENT AND TRADEMARK OFFICE

CERTIFICATE OF CORRECTION

PATENT NO. : 7,841,731 B2
APPLICATION NO. : 12/117063
DATED : November 30, 2010
INVENTOR(S) : Rudolf Marka and Dirk Fritze It is certified that error appears in the above-identified patent and that said Letters Patent is hereby corrected as shown below:

Title Page; item (75);
On page 1, column 1, after Rudolf Marka, delete "Ismauing" and insert --Insmaning--.

Signed and Sealed this
Twenty-second Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,841,731 B2
APPLICATION NO. : 12/117063
DATED : November 30, 2010
INVENTOR(S) : Rudolf Marka and Dirk Fritze It is certified that error appears in the above-identified patent and that said Letters Patent is hereby corrected as shown below:

Title Page; item (75);
On page 1, column 1, after Rudolf Marka, delete "Ismauing" and insert --Insmaning--.

This certificate supersedes the Certificate of Correction issued March 22, 2011.

Signed and Sealed this
Seventeenth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,841,731 B2
APPLICATION NO. : 12/117063
DATED : November 30, 2010
INVENTOR(S) : Rudolf Marka and Dirk Fritze It is certified that error appears in the above-identified patent and that said Letters Patent is hereby corrected as shown below:

Title Page; item (75);
On page 1, column 1, after Rudolf Marka, delete "Ismauing" and insert --Ismaning--.

This certificate supersedes the Certificates of Correction issued March 22, 2011 and May 17, 2011.

Signed and Sealed this
Third Day of January, 2012

David J. Kappos

David J. Kappos
*Director of the United States Patent and Trademark Office*